United States Patent [19]

Theurer et al.

[11] Patent Number: 4,784,063

[45] Date of Patent: Nov. 15, 1988

[54] MOBILE APPARATUS FOR LOADING, TRANSPORTING AND LAYING AN ASSEMBLED TRACK SECTION

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 36,069

[22] Filed: Apr. 9, 1987

[30] Foreign Application Priority Data

Jan. 29, 1987 [EP] European Pat. Off. ..... 87890019.0

[51] Int. Cl.[4] ..... E01B 29/02

[52] U.S. Cl. ..... 104/3; 180/8.1; 280/766.1; 414/339

[58] Field of Search ..... 104/2, 3, 5, 243, 306; 105/165, 171, 215.1; 414/339; 180/8.1, 8.5; 280/763.1, 766.1

[56] References Cited

U.S. PATENT DOCUMENTS

| | | | |
|---|---|---|---|
| 4,249,467 | 2/1981 | Theurer et al. | 104/3 |
| 4,261,264 | 4/1981 | Theurer et al. | 104/2 X |
| 4,566,389 | 1/1986 | Theurer et al. | 104/3 |
| 4,608,928 | 9/1986 | Theurer et al. | 104/3 |

FOREIGN PATENT DOCUMENTS

| | | | |
|---|---|---|---|
| 0196701 | 10/1986 | European Pat. Off. . | |
| 1759863 | 8/1971 | Fed. Rep. of Germany . | |
| 2432326 | 12/1975 | Fed. Rep. of Germany . | |
| 781205 | 5/1935 | France | 104/2 |

*Primary Examiner*—Robert B. Reeves
*Assistant Examiner*—Scott H. Werny
*Attorney, Agent, or Firm*—Kurt Kelman

[57] ABSTRACT

A mobile apparatus for loading, transporting and laying an assembled track section comprises a track section carrier comprising an elongated carrier frame, track section gripping and holding devices mounted on the elongated carrier frame, and two pairs of transversely opposite lifting jacks arranged on the carrier frame for lifting and lowering the carrier frame, the jacks of each pair being fixedly connected to each other and the pairs of jacks being widely spaced from each other in a longitudinal direction to provide a high stability during lifting and lowering of the carrier frame. A self-propelled auxiliary vehicle is movable independently of the track section carrier and comprises a flatbed frame having two opposite ends and capable of receiving and supporting the carrier with the assembled track section gripped and held thereon, and a track-bound undercarriage and an off-track undercarriage at each end of the flatbed frame.

12 Claims, 2 Drawing Sheets

MOBILE APPARATUS FOR LOADING, TRANSPORTING AND LAYING AN ASSEMBLED TRACK SECTION

The present invention relates to a mobile apparatus for loading, transporting and laying an assembled track section consisting of rails fastened to ties on a track bed.

European patent application No. 196,701, published Oct. 8, 1986, discloses such an apparatus comprising a succession of three independent track section carriers, each carrier comprising two pairs of transversely opposite lifting jacks arranged on the carrier frame for positioning on the track bed and including drives for vertically adjusting the jacks with respect to the track bed for lifting and lowering the carrier frame. The lifting jacks alongside each side of the carrier are closely adjacent each other and are interconnected by braces to form a rigid unit which is connected to a transverse displacement jack. The transverse displacement jacks for the lifting jack units are mounted on a carrier frame which is movably supported on flanged wheels on the track and mounts two gripping hooks for engaging each rail of the track section. The three track section carriers are placed with their flanged wheels on an assembled track section which has been placed next to a trackless renewal section where the track section is to be laid. The lifting jacks are then transversely displaced into an extreme lateral position facing the trackless renewal section and lowered onto the track bed. This causes the assembled track section gripped and held on the carrier to be lifted with the carrier and operation of the transverse displacement drives causes it to be displaced in the direction of the renewal section in an extreme end position. This transverse displacement is repeated in steps until the track section is in alignment with the trackless renewal section whereupon it is lowered thereonto. Since the jacks are closely spaced, the carrier is not stable during lifting and lowering of the heavy track section, and it is in danger of tipping over particularly when the track bed is uneven or soft. The operation is also rather time-consuming and difficult, which makes it uneconomical. Furthermore, there must be enough room for placing the assembled track section laterally adjacent the renewal section.

German patent application No. 2,432,326, published Dec. 4, 1975, discloses such an apparatus for handling track switch sections, which comprises a succession of carrier vehicles having a very short wheelbase and comprising pairs of transversely aligned flanged wheels at each end thereof for engagement with, and support on, the rails of the assembled track section, and a pair of lifting jacks and rail gripping means centered between the pairs of flanged wheels, and a succession of auxiliary vehicles consisting essentially of double-axled track-bound undercarriages capable of receiving and supporting the carrier vehicles and their flanged wheels with the assembled track section gripped by the rail gripping means. Adjacent carrier vehicles and auxiliary vehicles are connected by respective rods to form a train of auxiliary vehicles pulled on the railroad track by a tractor and a train of carrier vehicles supported on the auxiliary vehicles with respective track sections carried thereon. This apparatus has serious shortcomings, particularly in the handling of heavy switches. In view of the short wheelbase of the carrier vehicles and the provision of a single pair of lifting jacks at the center of the carrier vehicles, the carrier vehicles are very unstable when the lifting jacks are operated to lift the vehicle with the gripped track section off the track bed. During lifting, the assembly is supported only at two points and its stability depends essentially on the rigidity of the assembled track section. If the track section bends at one of its ends, for example, the entire assembly may tip over. The coupling rods between the vehicles cannot increase the stability since they merely serve to transmit pulling forces between the successive vehicles. The auxiliary vehicles are subject to a similar lack of stability since they essentially consist of undercarriages. In addition, the operation of the apparatus requires auxiliary track rails for the support of the auxiliary vehicles.

U.S. Pat. No. 4,608,928, dated Sept. 2, 1986, discloses a track section carrier comprising two telescoping elongated carrier frame parts. Each elongated carrier frame part has two widely spaced pairs of lifting jacks so that the carrier with the four pairs of lifting jacks and the track section lifted therewith may advance stepwise in an operating direction.

It is the primary object of this invention to simplify the structure of a mobile apparatus of the indicated type and to adapt the carrier for hoisting and laying even the heaviest track switches efficiently and accurately while transporting them stably, without the use of auxiliary tracks.

The above and other objects are accomplished according to the invention with a mobile apparatus for loading, transporting and laying an assembled track section consisting of rails fastened to ties on a track bed, which comprises (a) a track section carrier comprising an elongated carrier frame, means mounted on the elongated carrier frame for gripping and holding the assembled track section, and two pairs of transversely opposite lifting jacks arranged on the carrier frame for positioning on the track bed and including drives for vertically adjusting the jacks with respect to the track bed for lifting and lowering the carrier frame, the jacks of each pair being fixedly connected to each other and the pairs of jacks being widely spaced from each other in a longitudinal direction to provide a high stability during lifting and lowering of the carrier frame, and (b) a self-propelled auxiliary vehicle movable independently of the track section carrier, the auxiliary vehicle comprising a flatbed frame having two opposite ends and capable of receiving and supporting the carrier with the assembled track section gripped and held thereon, and a track-bound undercarriage and an off-track undercarriage at each end of the flatbed frame.

Such a mobile apparatus has a relatively simple structure and can safely handle even very heavy track sections. It is neither so short as to impair the stability of the track section carrier nor so long as to reduce the ease of operation. It can load, transport and lay even the heaviest track switches equipped with concrete ties and requires no time- and labor-intensive preparatory operations for transporting the track switches safely and directly to the trackless renewal section. The elongation of the carrier frame and the wide spacing of the pairs of lifting jacks from each other in a longitudinal direction made possible thereby imparts high stability to the track section carrier. This is of particular advantage in the handling of track switches, which are asymmetrical and have an eccentric point of gravity, since such track switches can be lifted and lowered on the widely spaced four-point support provided by the lifting jacks without any problems. The elongation of the carrier frame also provides a very favorable suspension of the heavy track section at a series of points along the length thereof. Because each end of the auxiliary vehicle carries a track-bound and off-track undercarriage for selective use, the track section may be moved between the track and the trackless renewal section without the need for an auxiliary track.

The above and other objects, advantages and features of the invention will become more apparent from the following detailed description of a now preferred embodiment thereof, taken in conjunction with the accompanying generally schematic drawing wherein FIG. 1 is a side elevational view showing two successively arranged mobile apparatuses for handling a 35 m long track switch, each apparatus comprising a track section carrier and an auxiliary vehicle;

Figure 1:
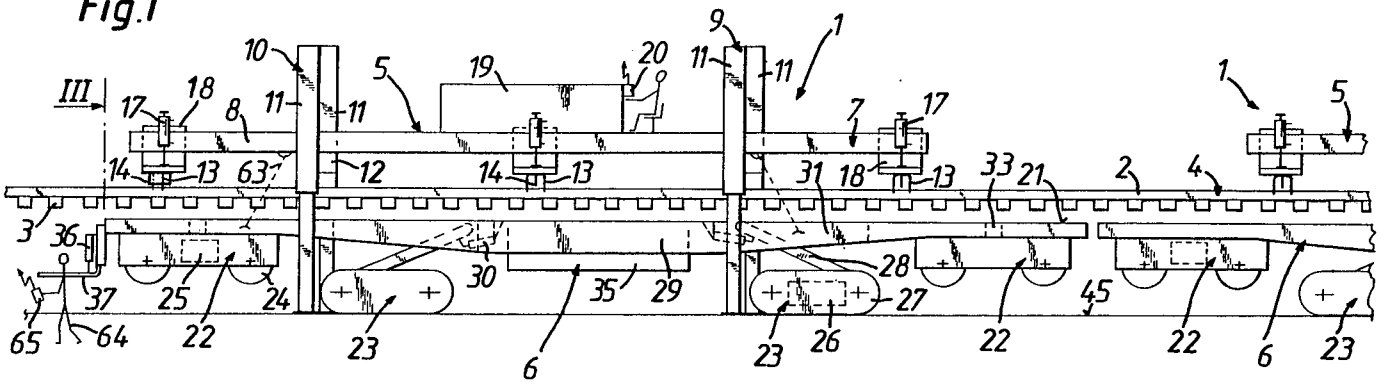
Figure 2:
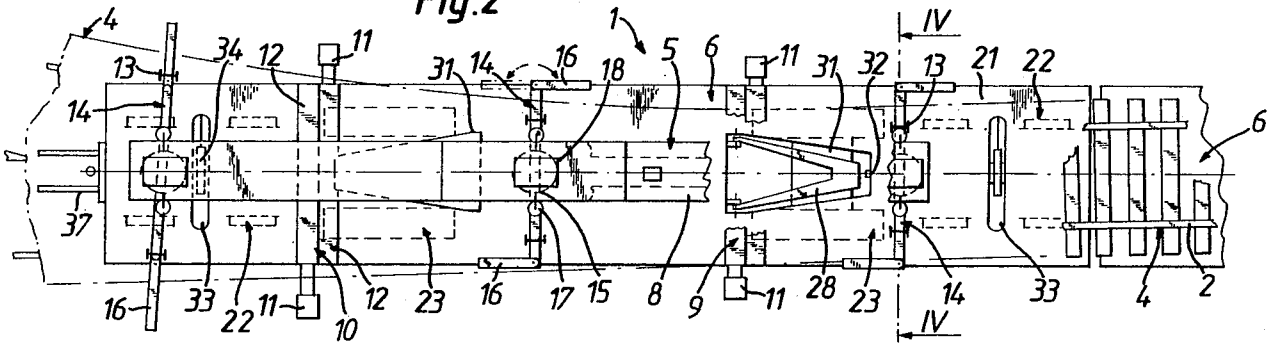
FIG. 2 is a top view of the front apparatus illustrated in FIG. 1.

Referring now to the drawing and first to FIGS. 1 and 2, each illustrated mobile apparatus 1 for loading, transporting and laying assembled track switch section 4 consisting of rails 2 fastened to ties 3 on a track bed comprises track section carrier 5 and auxiliary vehicle 6. The track section carrier comprises elongated carrier frame 7 consisting of two carrier beams 8. Means 13 for gripping and holding track switch 4 are mounted on elongated carrier frame 7. Two pairs 9 and 10 of transversely opposite lifting jacks 11 are arranged on the carrier frame for positioning on the track bed and include drives 43 (FIG. 3) for vertically adjusting the jacks with respect to the track bed for lifting and lowering carrier frame 7. The jacks are fixedly connected to each other and the pairs 9 and 10 of jacks 11 are widely spaced from each other in a longitudinal direction to provide a high stability during lifting and lowering of the carrier frame. As shown in the drawing, each pair of lifting jacks is substantially centered in a respective half of elongated carrier frame 7, and a preferably hydraulically operated transverse displacement jack 12 is connected to each lifting jack 11 for independently transversely positioning each lifting jack (FIG. 2). The elongated carrier frame may have a length of at least about 3 m and not exceeding about 15 m to enable assembled track sections with about 5 to 25 ties to be held thereon. The pairs 9 and 10 of lifting jacks are preferably spaced at least 2 m from each other in a longitudinal direction.

The illustrated spacing of the lifting jack pairs imparts great stability to the carrier and the independent transverse displaceability of the lifting jacks readily adapts the apparatus to the irregular asymmetrical circumference of track switches. The preferred dimensioning of the carrier frame and the spacing of the lifting jacks makes the apparatus very stable for handling relatively short track sections while limiting its weight and providing sufficient torsion resistance.

Means 13 for gripping and holding the assembled track section comprises respective rail gripping and holding devices arranged on elongated carrier frame 7 between pairs 9 and 10 of lifting jacks 11 and at respective opposite ends of the carrier frame, and each of the rail gripping and holding devices is independently transversely adjustable. The three transversely adjustable rail gripping and holding devices suspend the track section on the elongated carrier frame without subjecting the track section to damaging flexing forces and with an even distribution of the loading forces on the carrier frame.

Figure 6:
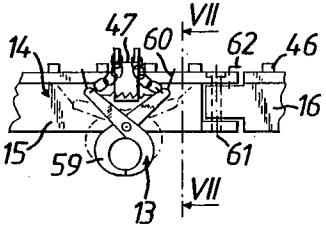
FIG. 6 is an enlarged fragmentary side view showing other structural details of the rail gripping and holding means.

As best shown in FIG. 6, rail gripping and holding devices 13 comprise tongs 59 for gripping and holding the heads of rails 2. Transversely extending guide rails 14 mount tongs 59 for transverse displacement, and each guide rail has center portion 15 arranged symmetrically with respect to carrier frame 7 and respective guide rail end portions 16 affixed to the center guide rail portion and pivotal about a respective vertical axis, pivot pin 61 connecting each guide rail end portion to the center guide rail portion. Such a rail gripping and holding means arrangement is particularly simple and robust in structure and carries heavy loads without problems. The tripartite construction of the guide rails enables the rail gripping and holding means to be adapted accurately to the different widths of a track switch along its length. The guide rail end portions need only be pivoted inwardly towards the carrier frame to enable the carrier to be moved from one operating site to another without laterally projecting parts. The use of clamping tongs for gripping the rail heads provides a secure grip on the rails of the track section.

Figure 4:
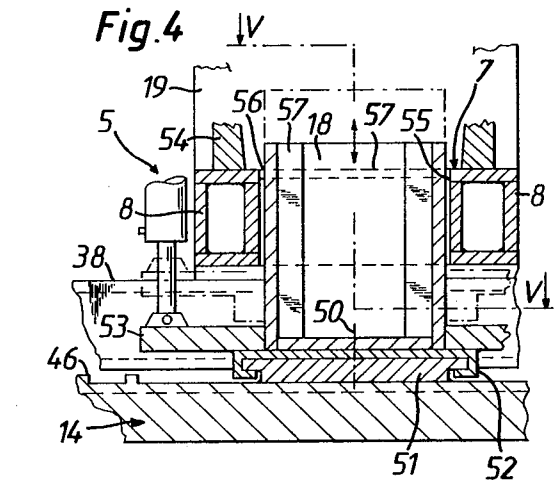
FIG. 4 is an enlarged cross sectional view along line IV—IV of FIGS. 2 and 5, showing structural details of the rail gripping and holding mean of the apparatus.

In the illustrated embodiment, preferably hydraulically operated power drives 17 connect center guide rail portions 15 to elongated carrier frame 7 for vertically adjusting the center guide rail portions on the carrier frame. Preferably parallelepiped guide body 18 is affixed to each center guide rail portion 15 and the center guide rail portion is rotatable with respect to guide body 18 about vertical axis 50 (FIG. 4). The elongated carrier frame defines respective guide passages 55 receiving the guide bodies affixed to the center guide rail portions. The vertically adjustable positioning of the guide rails enables the track section to be lifted or lowered without operating the lifting jacks, which facilitates the centering of the track section over the renewal section in conjunction with the rotation of the guide rail. In addition, this vertical adjustability increases the lifting stroke. The guiding body has the advantage of transmitting the operating forces to the carrier frame.

Central power plant 19 is mounted on carrier frame 7 between pairs 9 and 10 of lifting jacks 11, and remote control panel 20 enables an operator to control the operation of the various drives, including drives 17 as well as lifting jacks 11.

Figure 7:
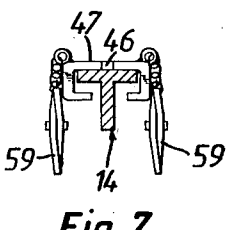
FIG. 7 is a cross sectional view along line VII—VII of FIG. 6.

As best shown in FIGS. 6 and 7, each gripping and holding device 13 comprises carrier yoke 47 displaceable along an upper side of guide rail 14 and a respective tong 59 is connected to the carrier yoke at a respective longitudinally extending side of the guide rail. A series of stop pins 46 arranged along the upper guide rail side enables the carrier yoke to be fixed in respective positions along the guide rail. The stop pins on the upper side of the guide rail enable the carrier yoke with the rail gripping tongs to be positioned rapidly along the guide rail and to be held securely in the set position.

Self-propelled auxiliary vehicle 6 is movable independently of track section carrier 5 and comprises flatbed frame 29 having loading platform 21 capable of receiving and supporting carrier 5 with assembled track section 4 gripped and held thereon, and track-bound undercarriage 22 and off-track undercarriage 23 at each end of the flatbed frame. In the illustrated embodiment, each track-bound undercarriage is a double-axled swivel truck having flanged wheels 24 and each off-track undercarriage is a track-laying undercarriage having two track-laying chains 27 of about the same gage as the gage of flanged wheels 24 of the track-bound undercarriage. Each track-laying undercarriage 23 is arranged immediately adjacent and inwardly of swivel truck 22 at each end of auxiliary vehicle 6, each track-laying undercarriage has its own drive 26 and each track-bound undercarriage has its own drive 25. Carrier bracket 28 is pivotally connected to flatbed frame 29 and carries the off-track undercarriage, and drive 30 is connected to each carrier bracket 28 for pivoting the off-track undercarriage into a retracted position. Flatbed frame 29 defines recess 31 configurated to receive track-laying undercarriage 23 in the retracted position, and device 32 is arranged to retain the retracted track-laying undercarriage in the flatbed frame recess. This specific arrangement of the track-bound and track-laying undercarriages has the advantage that the track section carrier will be rapidly and readily placed on the track when the carrier is returned from the renewal section to the track. Mounting the retractible track-laying undercarriage on a pivotal carrier bracket has the advantage that heavy loads will be safely transmitted to the track bed in any position of the track-laying undercarriages. The recess in the flatbed frame for receiving the track-laying undercarriage in the retracted position enables this undercarriage to be housed in the flatbed frame in a space-saving manner so that the height of the auxiliary vehicle can be held to a minimum and the retracted track-laying undercarriages do not interfere with the movement of the auxiliary vehicle on the track.

As may be best seen in FIG. 2, flatbed frame 29 has transversely extending guide 33 displaceably receiving swivel truck 22 for transversely adjusting the flatbed frame relative to the swivel truck. Drive 34 links the flatbed frame and the swivel truck for transverse adjustment. This enables the assembled track section carried by auxiliary vehicle 6 to be rapidly and accurately displaced laterally without requiring auxiliary devices which are complex and may interfere with the safety of the operation. For example, such a lateral adjustment may be readily effected in case a laterally projecting end of a track switch encounters an obstacle on the shoulder of the track.

As shown in FIG. 1, two successively arranged mobile apparatuses 1 may be used together for handling long track switches. If the track section to be handled is particularly heavy and/or very long, three or even four mobile apparatuses 1 may be used together.

As illustrated, power plant 35 for supplying power to the drives on auxiliary vehicle 6 is mounted on the underside of flatbed frame 29 centrally between the undercarriages of this vehicle and a vertically adjustable fork lift 37 is mounted at one end of the vehicle and is operated by vertical adjustment drive 36. For the sake of clarity, track switch 4 has been shown in FIG. 2 only in chain-dotted outline.

Figure 3:
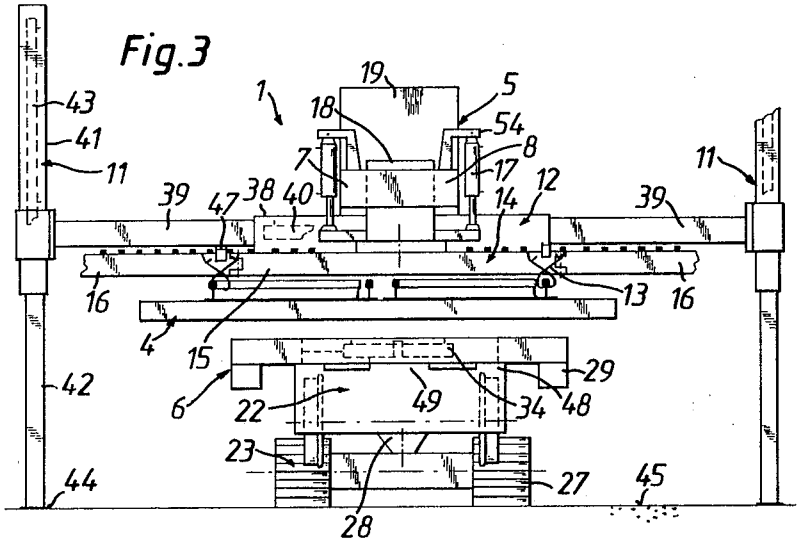
FIG. 3 is an enlarged front view of the apparatus seen in the direction of arrow III in FIG. 1.

As illustrated in FIG. 3, each transverse displacement jack 12 comprises guide sleeve 38 of preferably rectangular cross section and the guide sleeve telescopingly receives sleeves 39 displaceable in the guide sleeve by drives 40. The free ends of displaceable sleeves 39 are affixed to guide sleeves 41 of lifting jacks 11 and these guide sleeves are also preferably of rectangular cross section. Guide sleeves 41 telescopingly receive sleeves 42 displaceable in the guide sleeves by drives 43. Shoes 44 are mounted at the lower free ends of vertically displaceable sleeves 42 for supporting the lifting jacks on ballast bed 45.

A pair of devices 13 for gripping and holding rails 2 of track section 4 is mounted on each guide rail 14, which devices may be longitudinally displaced along the guide rail and held in the adjusted position by stop pins 46 on the upper side of the guide rail.

Carriage 48 mounts swivel truck 22 on the underside of flatbed frame 29 and centered guide pin 49 engages transverse guide slot 33 and is connected to drive 34. The piston rod of drive 34 is connected to the flatbed frame to enable the flatbed frame to be transversely adjusted on the swivel truck, carriage 48 providing a secure support for the flatbed frame.

As best shown in FIG. 4, guide rail 14 is vertically rotatable relative to guide body 18 about vertical axis 50. For this purpose, center guide rail portion 15 of guide rail 14 is connected with circular turntable 51 which, in turn, is received in turntable guide 52 connected to guide body 18. Crossbeam 53 is connected to guide body 18 and turntable guide 52, and the piston rods of vertical adjustment drives 17 are linked to the crossbeam while their cylinders are connected to brackets 54 affixed to carrier frame 7 (FIG. 3). Guide body 18 is vertically displaceably journaled in recess 55 defined between the two carrier beams 8 of carrier frame 7, a gap 56 being defined between the guide body and the carrier beams to permit vertical displacement of the guide body. The corners of guide body 18 are internally reinforced. The highest position of the guide body and guide rail 14 obtainable by operation of drives 17 is shown in chain-dotted lines in FIG. 4. As also shown in this figure, cover plate 57 is arranged on carrier beams 8 of carrier frame 7.

Figure 5:
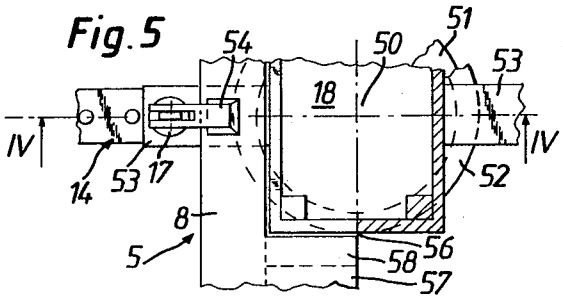
FIG. 5 is a top view and a cross section along line V—V of FIG. 4, illustrating the guide body and guidance of the rail gripping and holding means.

FIG. 5 clearly shows recess 55 bounded laterally by carrier beams 8 and further by crossbeams 58 connecting the carrier beams. Further crossbeams connect the ends of carrier beams 8.

As shown in FIGS. 6 and 7, guide rails 14 have a T-shaped cross section and rail gripping and holding tongs 59 are spring-biased into a closed position. The tongs are suspended on carrier yoke 47 by short chains. Handles 60 at the upper ends of the tongs enable them to be pressed into an open position against the spring bias so that the tongs may be engaged with the rail heads for gripping and holding the same. Guide rail end portions 16 are hinged to center guide rail portion 15 and the guide rail end portions may be held into an adjusted position by a removable bolt 62 affixing the guide rail portions to each other. Carrier yoke 47 may be lifted off the upper side of guide rail 14 sufficiently to clear stop pins 46 so that the rail gripping and holding devices 13 may be moved along the guide rail into desired lateral positions where the carrier yoke is lowered onto the upper guide rail side to enable an adjacent stop pin and to be held in that position.

One possible and preferred mode of operation of mobile apparatus 1 for removing a track switch having, for example, a length of 30 m will now be described to illustrate the operation of the apparatus.

The length of the track switch requires the use of two mobile apparatuses 1 in tandem, each apparatus comprising track section carrier 5 and auxiliary vehicle 6. The apparatuses are moved on track-bound undercarriages 22 to track section 4 to be removed, with carriers 5 resting on loading platforms 21 of auxiliary vehicles 6 and being secured thereto by ropes 63 shown in broken lines in FIG. 1. As soon as the apparatuses have been centered over track section 4, ropes 63 are removed and guide rails 14 are lowered to set carrier frame 7 onto loading platform 21. Transverse displacement jacks 12 are then operated to position lifting jacks 11 laterally adjacent track switch 4 and the lifting jacks are lowered to support their shoes 44 on ballast bed 45. Further operation of the lifting jacks will now lift track section carrier 5 off auxiliary vehicle 6. This operation is preferably carried out through remote control 65 by operator 64 standing on the track shoulder. The auxiliary vehicles are now removed and the lifting jacks are retracted to lower carrier 5 onto track section 4. The final vertical adjustment is effected by operation of drives 17 so that tongs 59 are in a position to grip and hold the heads of rails 2 of the track section. After the rails have been gripped, track section 4 is lifted by again extending vertically displaceable sleeves 42 of lifting jacks 11. As soon as the distance between the underside of the track section and track bed 45 is slightly more than the height of auxiliary vehicles 6, lifting of the track section is discontinued. The auxiliary vehicles are now moved back into the trackless renewal section on track bed 45 on lowered track-laying undercarriages 23. Some old ties may be used to form a small auxiliary ramp facilitating the transfer from the higher track rails to lower track bed 45. Fork lift 37 serves for the transport of these old ties. After auxiliary vehicles 6 have been accurately centered below carriers 5, the carriers with the track section gripped and held thereby are lowered onto loading platforms 21 of auxiliary vehicles 6 by retracting displaceable sleeves 42 of lifting jacks 11. After the carriers with the track section have thus been loaded on the auxiliary vehicles, they are secured on the auxiliary vehicles by ropes 63 and drives 26 are operated to move the assembly off the trackless renewal section on track-laying undercarriages 23. After the temporary ramp formed by old ties has been reached at the transfer point from trackless renewal section to adjacent track, pivoting drive 30 is operated to retract track-laying undercarriage 23 so that flanged wheels 24 of the immediately adjacent track-bound undercarriage 22 may engage the rails of the track. This change-over from track-laying to track-bound undercarriage is repeated until the entire assembly has been moved onto the track. If any obstacle on the track shoulder is encountered by a laterally projecting portion of track section 4 as the assembly moves along the track, drive 34 may be operated for suitable transverse adjustment to move the track section out of the way of such an obstacle. After the obstacle has been passed, the track section may be moved back. During the movement of the apparatus along the track, the operation is preferably controlled by an operator on carrier 5. Remote control 20 is used to control the drives for lowering and lifting the track section.

Laying of a track section is effected by reversing the above-indicated operational steps. Depending on the length of the track section to be handled, any number of sequentially arranged apparatuses 1 may be used and a relatively short track section may be handled by a single apparatus 1. It is also possible to leave carriers 5 at the renewal site for loading the old track section and laying the new track section while auxiliary vehicles 6 are used solely for transporting the respective track sections from and to the renewal section to a distant point where the track sections are loaded and unloaded by special cranes or other carriers 5 provided at such a distant point. On the other hand, the auxiliary vehicles may be used alone for transporting the track sections which are loaded and laid by special cranes.

What is claimed is:

1. A mobile apparatus for loading, transporting and laying an assembled track section consisting of rails fastened to ties on the track bed, which comprises (a) a track section carrier comprising (1) a carrier frame elongated in the direction of the rails, (2) means mounted on the elongated carrier frame for gripping and holding the assembled track section, (3) two pairs of transversely opposite lifting jacks arranged on the carrier frame for positioning on the track bed and including drives for vertically adjusting the jacks with respect to the track bed for lifting and lowering the carrier frame, and (4) transverse positioning means fixedly connecting the jacks of each pair to each other, and the pairs of jacks being widely spaced from each other in the longitudinal direction of the rails to provide a high stability during lifting and lowering of the carrier frame, and (b) a self propelled auxiliary vehicle movable independently of the track section carrier, the auxiliary vehicle comprising (1) an elongated flatbed frame having two opposite ends spaced from each other in said direction and capable of receiving and supporting the carrier with the assembled track section gripped and held thereon, and (2) a track-bound undercarriage and an off-track undercarriage at each end of the flatbed frame.

2. The mobile apparatus of claim 1, wherein each pair of lifting jacks is substantially centered in a respective half of the elongated carrier frame, and further comprising a transverse displacement jack connected to each lifting jack for independently transversely positioning each lifting jack.

3. The mobile apparatus of claim 1, wherein the elongated carrier frame has a length of at least about 3 m and not exceeding about 15 m to enable assembled track sections with about 5 to 25 ties to be held thereon.

4. The mobile apparatus of claim 1, wherein the pairs of jacks are spaced at least 2 m from each other in a longitudinal direction.

5. The mobile apparatus of claim 4, wherein the means for gripping and holding the assembled track section comprises respective rail gripping and holding devices arranged on the elongated carrier frame between the pairs of lifting jacks and at respective opposite ends of the carrier frame, each of the rail gripping and holding devices being independently transversely adjustable.

6. The mobile apparatus of claim 5, wherein the rail gripping and holding devices comprise tongs for gripping and holding the heads of the rails, and further comprising transversely extending guide rails mounting the tongs for transverse displacement, each guide rail having a center portion arranged symmetrically with respect to the carrier frame and respective guide rail end portions affixed to the center guide rail portion and pivotal about a respective vertical axis.

7. The mobile apparatus of claim 6, further comprising power drives connecting the center guide rail portions to the elongated carrier frame for vertically adjusting the center guide rail portions on the carrier frame, a guide body affixed to each center guide rail portion and the center guide rail portion being rotatable with respect to the guide body about a vertical axis, and the elongated carrier frame defining respective guide passages receiving the guide bodies affixed to the center guide rail portions.

8. The mobile apparatus of claim 7, wherein the guide body is a parallelepiped body.

9. The mobile apparatus of claim 6, wherein each guide rail has an upper side and two longitudinally extending sides, each gripping and holding device comprises a carrier yoke displaceable along the upper guide rail side and a respective one of the tongs connected to the carrier yoke at a respective longitudinally extending guide rail side, and a series of stop pins arranged along the upper guide rail side for fixing the carrier yoke in respective positions along the guide rail.

10. The mobile apparatus of claim 1, wherein each track-bound undercarriage is a swivel truck having flanged wheels and each off-track undercarriage is a track-laying undercarriage arranged immediately adjacent and inwardly of the swivel truck at each end of the auxiliary vehicle, and further comprising a drive for each track-laying undercarriage, a carrier bracket pivotally connected to the flatbed frame and carrying each track-laying undercarriage, and a drive connected to each carrier bracket for pivoting the track-laying undercarriage into a retracted position.

11. The mobile apparatus of claim 10, wherein the flatbed frame defines a recess configurated to receive the track-laying undercarriage in the retracted position, and further comprising a device for retaining the retracted track-laying undercarriage in the flatbed frame recess.

12. The mobile apparatus of claim 10, wherein the flatbed frame has a transversely extending guide displaceably receiving the swivel truck for transversely adjusting the flatbed frame relative to the swivel truck, and further comprising a drive linking the flatbed frame and the swivel truck for transverse adjustment.

* * * * *